US007063528B2

(12) United States Patent
Klobucar et al.

(10) Patent No.: US 7,063,528 B2
(45) Date of Patent: Jun. 20, 2006

(54) RADIANT TUBE AND CONVECTION OVEN

(75) Inventors: Joseph M. Klobucar, Ann Arbor, MI (US); David J. Cole, Canton, MI (US); Bruce Roesler, Wixom, MI (US); Douglas G. Smith, Livonia, MI (US); Adrien De Borchgrave d'Altena, Canton, MI (US); James L. Pakkala, Livonia, MI (US)

(73) Assignee: Durr Systems Inc., Plymouth, MI (US)

( * ) Notice: Subject to any disclaimer, the term of this patent is extended or adjusted under 35 U.S.C. 154(b) by 27 days.

(21) Appl. No.: 10/944,125

(22) Filed: Sep. 17, 2004

(65) Prior Publication Data

US 2005/0087183 A1 Apr. 28, 2005

Related U.S. Application Data

(60) Provisional application No. 60/513,748, filed on Oct. 23, 2003.

(51) Int. Cl.
*F26B 3/30* (2006.01)

(52) U.S. Cl. ..... 432/147; 34/266; 34/270

(58) Field of Classification Search ..... 432/175, 432/191, 202, 209, 147, 128; 34/215, 216, 34/266, 267, 270
See application file for complete search history.

(56) References Cited

U.S. PATENT DOCUMENTS 4,849,598 A * 7/1989 Nozaki et al. ..... 219/601
4,878,480 A * 11/1989 Watson et al. ..... 126/91 A
4,908,231 A * 3/1990 Nelson et al. ..... 427/542
5,060,594 A 10/1991 Tomioka et al.
5,588,830 A * 12/1996 Josefsson et al. ..... 432/147
5,661,912 A 9/1997 Bhatnagar et al.
5,836,085 A 11/1998 Ben-Ezra
6,062,850 A * 5/2000 Ino et al. ..... 432/143
6,769,909 B1 * 8/2004 Schwartz ..... 432/175
2004/0076919 A1 4/2004 Schwartz

FOREIGN PATENT DOCUMENTS

JP 611647673 7/1986

OTHER PUBLICATIONS

PCT/US2004/034615 International Search Report dated May 11, 2005.

* cited by examiner

*Primary Examiner*—Gregory Wilson
(74) *Attorney, Agent, or Firm*—Howard & Howard

(57) ABSTRACT

An oven for heating a coating on a substrate, such as a painted vehicle body, including a first zone having radiant tubes and shields above the tubes and a second zone including side heat chambers having nozzles directing heated air onto a coated substrate and a hold zone. The radiant tubes may include a first linear portion extending through the oven and return loop beneath the substrate to conserve energy and sill ducts directing heated air against the underside of the vehicle body. The temperature is controlled by sensors contacting the radiant tubes and a proportional integral control system.

29 Claims, 2 Drawing Sheets

RADIANT TUBE AND CONVECTION OVEN

RELATED APPLICATIONS

This application claims priority to U.S. Provisional Patent Application Ser. No. 60/513,748 filed Oct. 23, 2003.

BACKGROUND OF THE INVENTION

At present, paint and other coatings are baked or cured in a radiant oven, wherein the walls and/or floor are heated by combustion burners. In a typical automotive application, the painted vehicle body is conveyed through the radiant oven and the opposed side walls and generally the floor of the oven are heated by combustion burners which direct hot air into rectangular enclosures defining the side and bottom walls of the oven. This method of heating requires flame sensors to avoid a potential explosion which automatically turn off the flow of combustible gas to the burners in the event that the burner fails and combustible gas is directed into the enclosures thus shutting down the oven. The enclosures must then be purged of combustible gas before restarting the burners and restarting the oven. As a safety feature, if any of the flame sensors fail, the burners are automatically shut down for maintenance.

As will be understood by those skilled in this art, restarting a paint oven after shut down because of a failure of either the burner or a flame sensor requires time and thus considerable expense, but safety precautions must be maintained to avoid a hazardous condition. Radiant tube heaters have previously been used in automotive paint ovens, but only for supplemental heating of the rocker panels. It has now been proposed by General Motors Corporation to utilize radiant tube heaters that are pulse-fired to provide uniform surface temperature on the radiant tubes and the burners may be mounted external to the oven burner enclosures, thus allowing the use of the radiant tube heaters throughout the entire length of the oven. This method of heating a paint oven has several important advantages over the prior art. First, the potential for explosion is substantially eliminated because the radiant tube heaters may be formed of a schedule 40 pipe having a diameter of about six inches and a wall thickness of 0.280 inches, which are not subject to explosion even if the burners fail. The timing of the pulse-fire may be controlled by the surface temperature of the radiant tubes and a continuous spark may be utilized to ignite the combustible gas and air mixture, wherein combustible gas and air are mixed with a small portion of excess air and the mixture is at or near stoichiometric conditions. Further, a conventional paint oven has two sections, including a bring-up section and a hold section, wherein the temperature of the item being cured is brought to the paint curing temperature in the bring-up section and the curing temperature is maintained in the hold section as the painted substrate is moved through the oven. In a conventional paint oven, each section or zone uses a gas-fired heater to heat the zone as described above.

Although the described radiant tube oven provides important advantages over the prior art, further improvements are required to fully implement this invention, including improved control of the temperature of the painted substrate, such as an automotive body, to avoid overheating of areas adjacent the radiant tubes and to provide uniform heating of the substrate and improve efficiency, including conservation of energy. These advantages are provided by the radiant tube heat oven of this invention as described below.

SUMMARY OF THE INVENTION

The disclosed embodiment of the radiant tube and convection oven of this invention includes three distinct heat zones, comprising (1) a radiant bring-up zone, (2) a convection bring-up zone; and (3) a hold zone which more efficiently combines the advantages of radiant tube heating and convection heating to uniformly heat a painted or coated substrate without overheating areas and conserving energy. The radiant bring-up zone utilizes radiant tubes or tubular radiators along with a small amount of convection air directed at the underside of the substrate, such as the sill area of a painted vehicle body and is thus referred to as the "sill duct." The convection bring-up zone directs heated air onto the vehicle body from three groups of nozzles, including one set of large nozzles which direct heated air into the interior of the body through the window openings, one set of smaller nozzles which direct heated air at the sides of the vehicle body and one set of smaller nozzles which direct heated air at the underside of the vehicle body. The convection zone may be equipped with tubular radiators for additional heating. The hold zone utilizes tubular radiators along with a small amount of convective air, such as air directed at the sill area at the underside of the vehicle body. The three zones are described in more detail hereinbelow.

In one preferred embodiment, the radiant tube or pipe is positioned along one side wall of the oven adjacent to but spaced from the side wall and the radiant tube is then turned or bent 180° at the end of the radiant tube with an additional length of tube or pass running parallel to the direction of the conveyor travel, preferably beneath the substrate, such as the vehicle body. Utilization of this second run of pipe allows greater efficiency and utilization of the heat value of the fuel burned and improved distribution of the heat. The second length of radiant tube is preferably located near the floor of the oven and below the level of the conveyor. This allows for transfer of heat energy to the thicker metal parts of the vehicle body on the underside of the vehicle body. The second length of radiant tube may have the same diameter as the first length of tube, but may also have a larger diameter to reduce pressure loss and increase heat transfer. However, a smaller diameter for the second length of tube may be advantageous in fitting under the vehicle body, if space is limited.

The radiant tube and convection oven of this invention also contemplates the use of the products of combustion moving through the radiant tube to improve the overall thermal efficiency of the oven by directing the hot gases from the radiant tube into a secondary heat recovery system which may be utilized, for example, to heat the fresh air prior to circulation through the oven by a secondary heat recovery system that transfers heat from the hot gases exiting the radiant pipes. The three zones of the radiant tube paint oven of this invention will now be described in more detail.

In a preferred embodiment of the radiant tube and convection oven of this invention, the zones of the oven are collinear or axially aligned with the conveyor, such that the painted or coated substrate, such as the painted vehicle body, is conveyed through all three sections or zones of the oven and the radiant tube heaters extend through all three zones.

In the radiant bring-up section or zone, radiant tubes extend through the radiant bring-up zone preferably adjacent an intersection between the side wall and the bottom wall of the oven having a generally horizontal metal shield located above the radiant tube heaters to prevent overheating of the light metal parts of the vehicle body located above the radiant tubes. In a more preferred embodiment, the radiant bring-up zone also includes sill ducts located below the vehicle body in the vicinity of the door sills which may include a series or nozzles or holes directing air at the underside of the vehicle. The radiant tube heaters preferably receive pulse-fired gas burners which are heated to a surface temperature of between 400° F. and 1000° F. by the pulse-fired gas burners and the radiant tube heaters preferably have a wall thickness to prevent explosion.

In a preferred embodiment of the radiant tube and convection oven of this invention, the radiant tubes extend through the oven adjacent the outer lower corner of the oven wall and are then turned or bent 180 degrees and directed back through the oven in a second pass preferably located beneath the painted or coated substrate as described above. In the convective bring-up section or zone of the radiant tube and convection oven of this invention, a plurality of groups or sets of nozzles direct heated air into and onto the painted or coated substrate as the substrate is conveyed through the oven. All of the nozzles may be provided with swivel mountings to allow the nozzles to be aimed at specific areas or parts of the substrate and the nozzles may be bolted in place with spare mounting locations to provide further nozzles to be mounted from place to place. In a preferred embodiment, the convective bring-up zone includes outer chambers preferably located on the outer walls adjacent the upper portion of the convective bring-up zone receiving heated air and the nozzles direct the heated air into and onto the painted or coated substrate from the chambers through interior nozzles and side nozzles, preferably including three sets of nozzles. In a disclosed embodiment, the side walls of the interior chambers are angled at an acute angle relative to the side walls of the oven and the nozzles are mounted on the inclined side walls of the chambers. In a preferred embodiment, the air from the oven is circulated by a fan into the side chambers. Alternatively, the heated air may be directed to the enclosed heat chambers from a conventional burner located outside the convective bring-up zone.

The hold zone may be similar to the radiant bring-up zone, except that the volume of heated air delivered to the sill ducts is lower and a substantially constant temperature is maintained in the radiant tube and convection oven of this invention by a proportional integral derivative control system which includes a plurality of spaced temperature probes in direct contact with the exterior of the radiant heat tubes as described further below.

As will be understood, various modifications may be made to the radiant tube and convection oven of this invention within the purview of the appended claims and the following description of the preferred embodiments is for illustrative purposes only.

DESCRIPTION OF THE PREFERRED EMBODIMENTS

Figure 1:
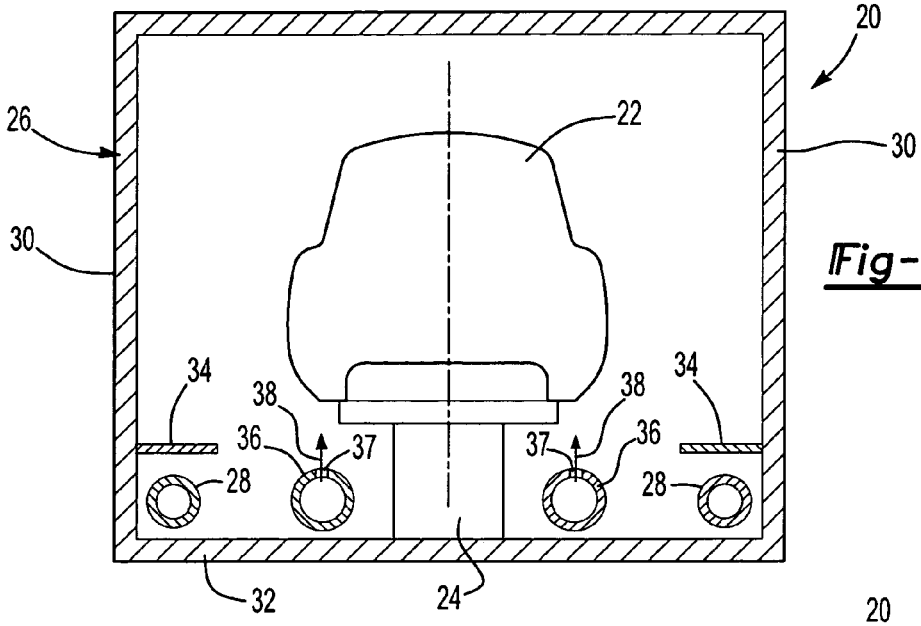
FIG. 1 is a partially schematic end view of one embodiment of the radiant bring-up zone of the radiant tube and convection oven of this invention.

The radiant tube and convection oven 20 of this invention may be utilized to cure or bake paint or other coatings on various substrates, such as a automotive body or substrate 22, which are conveyed through the oven 20 on a conveyor 24 generally through the longitudinal axis of the oven 20. The radiant tube and convection oven 20 of this invention includes three zones, including a radiant bring-up zone, a convection or convective bring-zone and a hold zone. In a preferred embodiment, the three zones are coaxially or linearly aligned, such that the outer wall 26 of the oven 20 encloses all three zones and the conveyor 24 conveys the automotive body 22 through all three zones of the oven 20. As will be understood by those skilled in this art, however, the radiant tube and convection oven 20 of this invention may include more than three zones, but preferably includes at least three zones.

FIG. 1 illustrates one embodiment of the first zone of the radiant and convection oven of this invention, which is the radiant bring-up zone. The embodiment of the radiant bring-up zone shown in FIG. 1 includes two radiant tubes or radiant tube heaters 28 on opposed sides of the oven 20, preferably located adjacent the lower outer corners of the outer wall 26 of the oven 20 or more specifically adjacent to but spaced from the intersections of the side walls 30 and the bottom wall 32 of the oven 20. In the preferred embodiment of the radiant tube and convection oven 20 of this invention, radiant shields 34 are located above and adjacent to the radiant tubes 28 which prevent overheating of the light metal parts of the vehicle body 22. The radiant shields 34 may be planar, as shown, or arcuate and may be formed of any durable opaque material, preferably sheet steel. The radiant shields 34 may be curved, bent or flat as long as the radiant shields block the line of sight between the radiant tubes 28 and the light metal areas of the vehicle body 22, such as doors, fenders and roofs.

The radiant tube heaters 28 are preferably heated to a surface temperature of between 400° F. and 1000° F. by pulse-fired gas burners, as described above. The radiant tube heaters 28 are preferably formed of steel and are substantially explosion proof. A suitable radiant tube may be formed of schedule 40 pipe having a diameter of about six inches and a wall thickness of about 0.280 inches.

In a preferred embodiment of the radiant tube and convection oven 20 of this invention, the radiant tube heaters 28 and radiant shields 34 are used in combination with sill ducts 36 which are preferably located beneath the vehicle body 22 adjacent the sill area of the vehicle under each side of the vehicle body 22. As will be understood by those skilled in this art, sill ducts 36 typically include a series of holes or nozzles 37 directing heated air onto the sill area of the vehicle body and may include one or a plurality of aligned holes or nozzles spaced six to twelve inches apart each having an opening between 0.5 and 1.5 inches, preferably about 0.75 inches, located between six and twelve inches from the sill area of the vehicle body, preferably about nine inches, directing heated air to the sill area of the body as shown by arrows 38. The holes or nozzles in the sill ducts 36 preferably deliver air at a volumetric rate of between 25 and 100 cubic feet per minute or preferably about 50 cfm per foot of oven length. In a preferred embodiment, the radiant tubes 28 and the sill ducts 36 extend the interior length of the oven 20, that is extending through all three zones.

Figure 2:
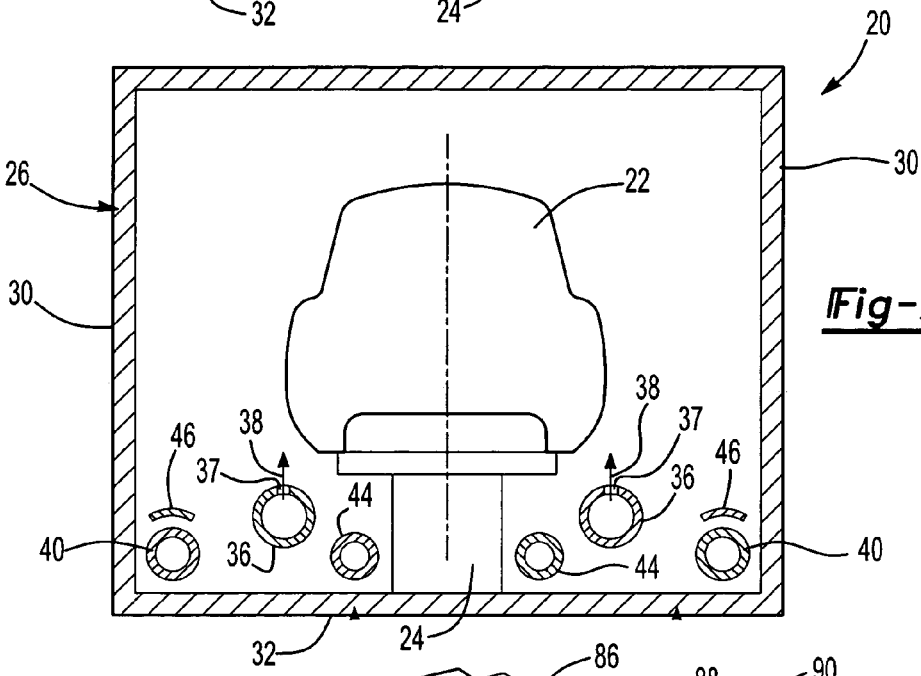
FIG. 2 is an end view of an alternative embodiment of the radiant bring-up zone shown in FIG. 1.
Figure 3:
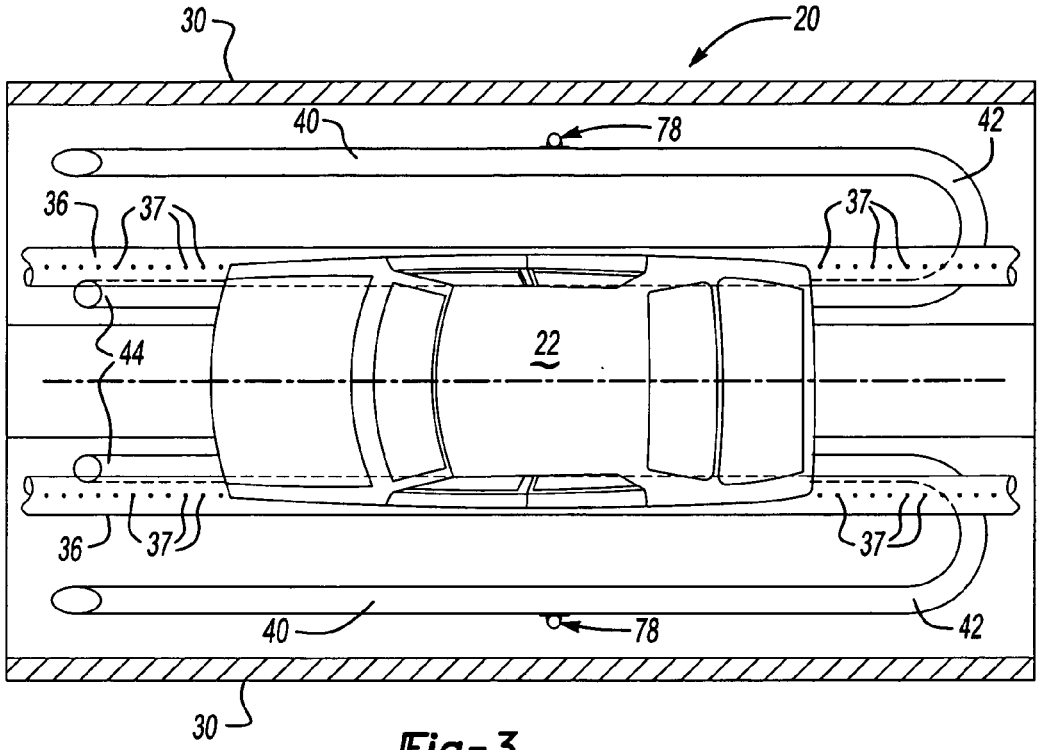
FIG. 3 is a top view of the embodiment of the radiant bring-up zone shown in FIG. 2.

FIGS. 2 and 3 illustrate and alternative embodiment of the radiant bring-up zone which provides further efficiencies and conserves heat. As shown in FIG. 2, the embodiment of the radiant bring-up zone includes the sill ducts 36 and radiant tube heaters 40 adjacent to, but spaced from the intersections of the side walls 30 and the bottom wall 32 as describe above with reference to FIG. 1. However, in this embodiment of the radiant bring-up zone, the radiant tubes 40 are turned or bent inwardly beneath the vehicle body 22 as shown in FIG. 3. That is, the radiant tubes 40 are turned or bent 180 degrees in an arcuate or elbow portion 42 and returned in a return pass 44 preferably beneath the painted or coated substrate 22 as also shown in FIG. 2. The return pass 44 beneath the vehicle body 22 provides for transfer of heat energy to the thicker metal parts of the vehicle body on the underside of the vehicle body. Utilization of a second pass 44 of the radiant tube 40 also provides greater efficient utilization of the heat value of the fuel burned and improved distribution of the heat in the radiant tube and convective oven 20 of this invention. As set forth above, the radiant tubes 40 and the return pass 44 preferably extend through all three zones of the radiant tube and convection oven of this invention. The second passes 44 of the radiant tubes 40 may have the same diameter as the first radiant tube 40. However, a larger diameter of the second pass 44 may be advantageous in reducing pressure loss or increased heat transfer. However, a smaller size in the return pass 44 may be advantageous where space beneath the vehicle body 22 is limited. In the embodiment of the radiant bring-up zone shown in FIG. 2, radiant shields 46 located above the radiant tubes 40 are arcuate or curved and spaced from the side walls 30. The radiant shields 46 may be supported by spaced brackets (not shown) attached to the side walls 30 and the spacing between the radiant shields 46 and the side walls 30 permit heat to radiate between the radiant shields 46 and the side walls 30. The radiant shields 46 are not shown in FIG. 3 to better illustrate the radiant tubes 40, including the return pass 44.

Figure 4:
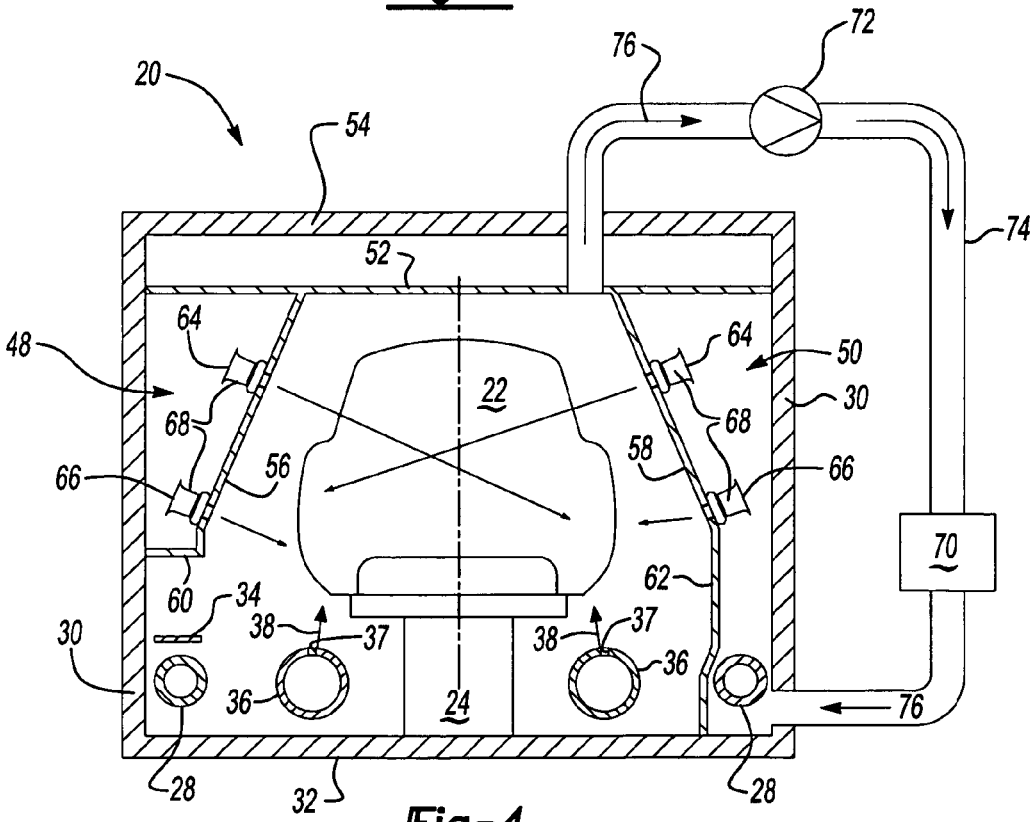
FIG. 4 is an end cross-sectional view of one embodiment of the convective bring-up zone of the radiant tube and convection oven of this invention.

The embodiment of the second zone of the radiant tube and convection oven shown in FIG. 4 is the convective bring-up zone. As set forth above, the radiant tubes 28 and the sill ducts 36 preferably extend through the interior length of the radiant tube and convection oven 20. Alternatively, the radiant tubes 40 may include a return pass as shown in FIG. 3. The disclosed embodiment of the convective bring-up zone shown in FIG. 4 further includes a first chamber or heat chamber 48 adjacent one side wall 30 and a second chamber or heat chamber 50 adjacent the opposed side wall 30. The first and second chambers 48 and 50 are defined by an upper wall 52 parallel to an upper wall 54 of the oven 20 and side walls 56 and 58 which, in the disclosed embodiment, are preferably inclined outwardly from the upper wall 52 as shown in FIG. 4. In the disclosed embodiment of the convective bring-up zone shown in FIG. 4, the first chamber 48 is further defined by a bottom or end wall 60 which extends to the side wall 30 of the oven 20. The second chamber 50 may be similarly configured with an end or bottom wall as shown at 60. However, in the embodiment shown in FIG. 4, the inclined side wall 58 is continued downwardly in a generally vertical wall 62 which extends to the bottom wall 32 of the oven 20 enclosing the radiant tube 28 in the second chamber 50. As will be understood, the embodiment of the convective bring-up zone shown in FIG. 4 does not include the return pass 44 of the radiant tubes 40 shown in FIGS. 2 and 3, but would include the return pass 44 if the embodiment of the radiant bring-up zone shown in FIGS. 2 and 3 is adopted.

Heated air is directed from the chambers 48 and 50 to the substrate 22 by two groups of upper and lower nozzles 64 and 66. The upper nozzles 64 direct heated air into the interior of the vehicle body 22 through the window areas and the lower nozzles 66 direct heated air against the lower quarter panels of the vehicle body 22. In the disclosed embodiment, the body portion of the nozzles 64 and 66 within the first and second chambers 48 and 50 is tubular having an open end and the nozzles include a generally bell-shaped swivel nozzle portion 68, such that the heated air from the first and second chambers 48 and 50 may be directed as desired for the application. The combined airflow from all the upper and lower nozzles 64 and 66 provide a volumetric airflow of between 250 and 1000 cfm per foot of oven, preferably about 500 cfm per foot of oven and the flow range results in four to six air changes per minute. The temperature of the delivered air is within ±50° F., preferably ±20° F. of the target metal temperature of the substrate, which in the disclosed embodiment is the vehicle body 22. The upper nozzles 64 which direct heated air into the interior of the vehicle body 22 preferably have a larger diameter (not shown) than the lower nozzles 66 to project heated air into the corners of the vehicle body 22 and may have an opening diameter between four and twelve inches, preferably about six inches in diameter. The lower nozzles 66 may have smaller openings, preferably between one and six inches in diameter, preferably between three and four inches in diameter.

In the embodiment of the convective bring-up zone shown in FIG. 4, heated air may be directed into the enclosed heat chamber 50 from a fan 72 through a conduit 74 located outside the convection bring-up zone. In this case, heat is provided by the radiant tube 28. The heat chamber 50 may also be heated by an optional auxiliary burner 70 and heated air is directed from the oven 20 by fan 72 through the conduit 74 as shown by arrow 76. The heated air is then directed into the chamber 50. As will be understood from the above description of the convective bring-up zone shown in FIG. 4, the chamber 48 may be identical to the chamber 50, including an optional auxiliary burner 70 in the conduit 74 or the chamber 50 may be identical to the chamber 48 and the chamber 50 may then be heated by a conventional burner as described above with regard to chamber 48. Further, as set forth above, the radiant tubes 28 and the sill ducts 36 preferably extend through the radiant tube and convection oven 20 of this invention, wherein the sill ducts 36 direct heated air to the sill area of the vehicle body 22 as shown by arrows 38.

The final zone of the radiant tube and convection oven 20 of this invention is the hold zone, wherein the final curing or baking of the coating on the substrate 22 occurs. The hold zone may be identical to FIG. 1 or FIGS. 2 and 3 described above, except that the volume of heated air delivered to the sill ducts 36 is preferably lower, preferably in the range of 5 to 50 cfm per foot of oven, preferably about 25 cfm per foot of oven. This may be accomplished by providing fewer holes in the sill ducts 36 in the hold zone of the radiant tube and convection oven of this invention.

Figure 5:
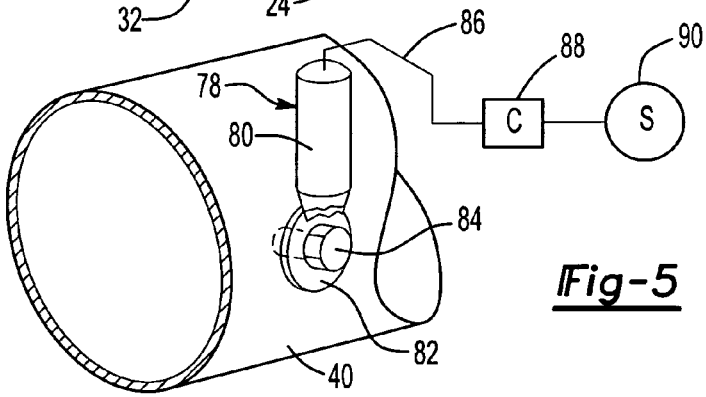
FIG. 5 is a side partially schematic perspective view of the temperature control system.

As will be understood, it is desirable to maintain a substantially constant temperature in each zone of a paint oven. This may be accomplished with the radiant tube and convection oven 20 of this invention utilizing a control loop, such as a proportional integral derivative (PID) control system. In a preferred embodiment of the radiant tube and convection oven 20 of this invention, the radiant tubes 28 in FIGS. 1 and 4 and 40 and 44 in FIGS. 2 and 3 include a plurality of spaced temperature probes or thermocouples 78 preferably in direct contact with the exterior of the radiant tubes 40 as shown, for example, in FIG. 5. For illustrative purposes, FIG. 5 illustrates the temperature probe 78 on the radiant tube 40 of FIGS. 2 and 4. The temperature probe 78 includes an outer shell or sheath 80 having an integral washer 82 in direct contact with the radiant tube 40 and bolted to the radiant tube 40 by a bolt 84. A sensor (not shown) may be a type K thermocouple which is located within the outer shell or sheath 80. The thermocouple 78 is then connected by wire 86 to a controller 88. In a preferred embodiment, the wire 86 is surrounded by flexible metal armor (not shown) to protect the wire 86. As will be understood, the radiant tube 40 and the return pass 44 may include a plurality of spaced thermocouples 78 connected to the controller 88 and the radiant tube and convection oven 20 of this invention may also include a plurality of sensors 90 which may be suspended within each of the zones of the oven 20 at appropriate locations to determine the air temperature of the paint oven in each of the zones described above. The sensors 90 and temperature probes 78 are each connected to the controller 88 which includes an appropriate PID control loop which is connected to the burners 70 delivering heat to the radiant tubes 28 and 40 and the burners 70 directing heated air into the chamber 48 and the burner 70 to control the temperature of the oven 20.

Finally, the radiant tube and convection oven 20 of this invention may include a secondary heat recovery to improve the overall thermal efficiency of the oven 20. This may be accomplished by directing the hot gas received from the radiant tubes (28 and 40) into a heat recovery system which may be utilized, for example, to heat the fresh air received by the radiant tube and convention oven 20. For example, the outlet from the oven 20 of the radiant tubes 28 and 40 may be include a sheath which coaxially surrounds the radiant tubes 28 and 40 and fresh air may be drawn into one end of the sheath and flows through the annular space and heated by convection and radiation from the radiant tubes 28 and 40. The fresh air would then be ducted to the inlet of a conventional fresh air heater where it would be heated additionally by normal means to the required temperature. The secondary recovery system may be of a more conventional design, wherein several radiant tubes 28 and 40 are manifolded together and fed into a single heat exchanger. In this case, explosion relief would be incorporated into the manifold and heat exchanger.

As set forth above, the radiant tube and convection oven 20 of this invention preferably includes at least three zones, including a radiant bring-up zone, a convection bring-up zone and a hold zone, wherein the substrate, such as the vehicle body 22 is conveyed through the oven 20 on the conveyor 24 and wherein the zones are coaxial or collinear having a common enclosure. However, the radiant tube and convection oven 20 of this invention may be utilized to dry or cure any coating on any substrate and is thus not limited to a paint cure oven as disclosed. Further, various modifications may be made to the disclosed embodiments of the radiant tube and convection oven of this invention within the purview of the appended claims and the disclosed embodiments are for illustrative purposes only. For example, the chambers 48 and 50 may be identical, as described above, and the return pass 44 of the radiant tube 40 is optional, although preferred in applications where heat conservation is desired or preferred. Having described preferred embodiments of the radian tube and convection oven 20 of this invention, the invention is now claimed as follows.

The invention claimed is:

1. A radiant tube and convection oven for heating a coating on a substrate conveyed through said oven, comprising:

an oven wall enclosing a plurality of zones, including a radiant bring-up zone having a plurality of radiant tubes extending through said oven receiving heated air from a burner and shields located above and generally between said radiant tubes and said substrate blocking a direct line of sight between said radiant tubes and said substrate reducing radiant heating of said substrate, and a convection bring-up zone, including a plurality of nozzles directing heated air at said substrate.

2. The radiant tube and convection oven as defined in claim 1, wherein said radiant tubes each include a temperature sensor in contact with a surface of said radiant tubes, said sensors connected to a control and said control connected to a burner directing heated air into said radiant tubes, controlling a temperature of said oven.

3. The radiant tube and convection oven as defined in claim 2, wherein said oven further includes temperature sensors located within said oven spaced from said radiant tubes connected to said control further controlling a temperature of said oven.

4. The radiant tube and convection oven as defined in claim 1, wherein said radiant tube and convection oven includes ducts located beneath said substrate extending through said oven receiving heated air from a burner having a plurality of spaced openings directing heated air onto an underside of said substrate.

5. The radiant tube and convection oven as defined in claim 1, wherein said radiant tubes each include a return loop extending back through said oven receiving heated air from said radiant tubes.

6. The radiant tube and convection oven as defined in claim 5, wherein said return loops extend below said substrate.

7. The radiant tube and convection oven as defined in claim 5, wherein said return loops each include a U-shaped portion connected to said radiant tubes and a linear portion extending back through said oven.

8. The radiant tube and convection oven as defined in claim 1, wherein said radiant tubes are each located adjacent an outer corner of said outer wall of said oven and said shields are located above said radiant tubes.

9. The radiant tube and convection oven as defined in claim 1, wherein said shields are flat and located above said radiant tubes.

10. The radiant tube and convection oven as defined in claim 1, wherein said shields are arcuate and located above said radiant tubes.

11. The radiant tube and convection oven as defined in claim 1, wherein said radiant tube and convection oven includes a hold zone located downstream of convection bring-up zone including said radiant tubes.

12. The radiant tube and convection oven as defined in claim 1, wherein said substrate is a vehicle body having open windows and said nozzles are located opposite said open windows directing heated air into said open windows of said vehicle body.

13. The radiant tube and convection oven as defined in claim 12, wherein said nozzles are located on inclined walls of said chambers receiving heated air.

14. The radiant tube and convection oven as defined in claim 1, wherein said convection bring-up zone includes heat chambers on opposed sides of said oven wall and said nozzles are located on a wall of said heat chambers opposite said substrate.

15. An oven for heating a coating on a vehicle body conveyed through said oven, comprising:

an oven wall enclosing a plurality of zones, including a radiant build-up zone having a plurality of radiant tubes extending through said oven receiving heated air from a burner, said radiant tubes each including a first generally linear portion extending generally through said oven below said vehicle body, a generally U-shaped portion adjacent an end of said oven receiving heated air from said first generally linear portion, and a second generally liner portion having a diameter smaller than said first linear portion receiving heated air from said U-shaped portion extending back through said oven below said vehicle body.

16. The oven as defined in claim 15, wherein said oven includes shields located generally between said first linear portions of said radiant tubes and said substrate.

17. The oven as defined in claim 15, wherein said radiant tubes each include a temperature sensor in contact with a surface of said radiant tubes, said temperature sensor connected to a control and said control connected to a burner directing heated air into said radiant tubes, controlling a temperature in said oven.

18. The oven as defined in claim 15, wherein said oven includes a convection bring-up zone following said radiant bring-up zone including a plurality of nozzles directing heated air at said substrate.

19. A radiant rube and convection oven for heating a coating on a substrate conveyed through said oven, comprising:

an oven wall enclosing a plurality of zones, including a radiant bring-up zone having a plurality of radiant tubes extending through said oven receiving heated air from a burner, and a convection zone including said radiant tubes and a plurality of nozzles directing heated air at said substrate, said radiant tubes each including a temperature sensor in contact with a surface of said radiant tubes, said sensors connected to a control and said control connected to a burner directing heated air into said radiant tubes, controlling a temperature of said oven.

20. The radiant tube and convection oven as defined in claim 19, wherein said radiant tubes each include a temperature sensor in contact with a surface of said radiant tubes, said temperature sensor connected to a control and said control connected to a burner directing heated air into said radiant tubes controlling a temperature of said oven.

21. The radiant tube and convection oven as defined in claim 20, wherein said oven includes temperature sensors located within said oven spaced from said radiant tubes connected to said controller further controlling a temperature within said oven.

22. The radiant tube and convection oven as defined in claim 19, wherein said radiant tube and convection oven includes sill ducts located beneath sills of said vehicle body receiving heated air from a burner having a plurality of spaced openings directing heated air onto said sills of said vehicle bodies.

23. The radiant tube and convection oven as defined in claim 19, wherein said radiant tubes each include a return loop extending back through said oven receiving heated air from said radiant tubes.

24. The radiant tube and convection oven as defined in claim 23, wherein said return loops extend below said vehicle bodies on opposed sides of said conveyor.

25. The radiant tube and convection oven as defined in claim 23, wherein said return loops each include a U-shaped portion connected to said radiant tubes and a linear portion extending back through said oven.

26. The radiant tube and convection oven as defined in claim 19, wherein said nozzles are located on inclined walls of said chambers receiving heated air.

27. A radiant tube and convection oven for heating a coating on vehicle bodies having open windows conveyed through said oven, comprising:

an oven wall enclosing a plurality of zones, including a radiant bring-up zone having a plurality of radiant tubes extending through said oven receiving heated air from a burner and shields located generally between said radiant tubes and said substrate, and a convection zone including said radiant tubes and a plurality of nozzles located opposite said open windows directing heated air into said open windows of said vehicle body.

28. A radiant tube and convection oven for heating a coating on a substrate conveyed through said oven, comprising:

an oven wall enclosing a plurality of zones, including a radiant bring-up zone having a plurality of radiant tubes extending through said oven receiving heated air from a burner and shields located generally between said radiant tubes and said substrate, and a convection bring-up zone including heat chambers on opposed sides of said oven wall and nozzles located on a wall of said heat chambers opposite said substrate directing heated air at said substrate.

29. An oven for heating a coating on a substrate conveyed through said oven, comprising:

an oven wall enclosing a plurality of zones, including a radiant bring-up zone having a plurality of radiant tubes extending through said oven receiving heated air from a burner, said radiant tubes including a first generally linear portion extending generally through said oven, a generally U-shaped portion receiving heated air from said first generally linear portion, and a second generally linear portion receiving heated air from said U-shaped portion extending back through said oven, each of said radiant tubes including a temperature sensor in contact with a surface of said radiant tubes, said temperature sensor connected to a control and a control connected to a burner directing heated air into said radiant tubes, controlling a temperature of said oven.

* * * * *